US005681146A

United States Patent [19]

White

[11] Patent Number: 5,681,146

[45] Date of Patent: Oct. 28, 1997

[54] LOW HEAD PUMPING SYSTEM FOR FISH FARMS

[75] Inventor: Theodore Baxter White, Ladysmith, Canada

[73] Assignee: Future Sea Farms Inc., Nanaimo, Canada

[21] Appl. No.: 726,258

[22] Filed: Oct. 4, 1996

[51] Int. Cl.[6] ..... F01D 5/14

[52] U.S. Cl. ..... 416/223 R; 416/238

[58] Field of Search ..... 416/223 R, 238, 416/234, DIG. 2, DIG. 5

[56] References Cited

U.S. PATENT DOCUMENTS

| | | | |
|---|---|---|---|
| 26,213 | 11/1859 | Tripp . | |
| 1,991,095 | 2/1935 | Hochstetter . | |
| 3,081,826 | 3/1963 | Loiseau | 416/238 |
| 4,505,641 | 3/1985 | Tsuchikawa et al. | 416/238 |
| 4,801,243 | 1/1989 | Norton | 416/238 |
| 5,197,931 | 3/1993 | Yapp et al. | 416/223 R |
| 5,226,804 | 7/1993 | Do . | |
| 5,249,993 | 10/1993 | Martin | 416/223 R |
| 5,513,951 | 5/1996 | Komoda et al. | 416/223 R |

*Primary Examiner*—John T. Kwon
*Attorney, Agent, or Firm*—C. A. Rowley

[57] ABSTRACT

An impeller pump for moving large volumes of liquid against heads of up to 1 meteris formed by a substantial circular housing having its axis substantially vertical in which an impeller is mounted for rotation on the central axis. The impeller has an maximum diameter substantially equal to the inside diameter of the housing and is formed with a hub and the plurality of blades symmetrically positioned around the hub. Each blade extends radially outward of the hub from a root to a tip and has a foil shaped cross section with a lift to drag ratio at least 75 to 1 at a Reynolds number of under $10^6$. Each of the blades is skewed rearward in the direction of blade rotation so that the apparent aspect ratio of blade is increased and to reduce operating noise. Each blade has an angle of attack of between 2° and 6° and has a rake in the direction of flow through the impeller of between 3° and 7°. The impeller lifts water through the housing and directs it into the fish farm.

20 Claims, 3 Drawing Sheets

LOW HEAD PUMPING SYSTEM FOR FISH FARMS

FIELD OF INVENTION

The present invention relates to a pump, more particularly, the present invention relates to a low head high volume pump for circulating water to a fish farm.

BACKGROUND OF THE INVENTION

It is well known to breed fish in so called "bag" type farms wherein the fish are corralled in a confined zone within a large body of water. U.S. Pat. Nos. 3,716,024 issued Feb. 13, 1973 to Lawson; 3,900,004 issued Aug. 19, 1975 to Goldman et al.; 4,144,840 issued Mar. 20, 1979 to Bubien; 4,422,408 issued Dec. 27, 1983 to Pohlhansen; 4,615,301 issued Oct. 7, 1986 to MacKaw; 4,711,199 issued Dec. 8, 1987 to Nynan; and 4,798,186 issued Jan. 17, 1989 to Gartnervn show examples of such fish farms.

These farm systems use a variety of different types of conventional type pumps for circulating the water into and out of the bag or confinement like in which the fish are raised. Conventional pumps such as centrifugal pumps and the like as are normally used for these systems are relatively expense to operate and have high power requirements, necessitating large power source as most of the fish farms do not have a readily available source of electrical power to drive the pumps Impellers for moving fluids are not new, many different forms of impellers have been devised for moving water. Generally, impellers are used for example, to drive boats or as the air movers in fans or the like. Also impeller type turbines are used to generate electricity by operating in reverse to pump in that they derive power from the flow of water rather than applying power to the water.

The use of swept back blades on impellers has been know for many years, see U.S. Pat. No. 26,213 issued Nov. 22, 1959 to Trip that describes a screw type propeller for use in a boat. The swept back blades as taught by Trip is not suitable for the present invention and in fact would not be effective when used under low head conditions as is required for fish farms.

U.S. Pat. No. 1,991,095 issued Feb. 12, 1935 to Hochsetter, describes a pressure fan for moving air, apparently, without creating as much noise as those used prior to that invention. This impeller is not effective for the purposes of moving water against low head in that the hub has too large a diameter and the blades are too wide measured in the circumferential direction which causes undue turbulence that produce high Reynolds numbers unsuitable for fish farm pumping applications.

U.S. Pat. No. 5,249,993 issued Oct. 5, 1993 to Martin, describes a weed resistant impeller for driving a boat or the like having a rearwardly curve leading edge and a portion of the blade at the leading edge adjacent to the root of the blade overlaps the rear trailing edge of its immediately preceding blade.

U.S. Pat. No. 5,226,804 issued Jul. 13, 1993 to Doh, describes a propeller type runner for a turbine wherein the leading edge of the blade leans forward from the root in the direction of rotation to produce an improved operation under conditions of a low head high volume water flow.

BRIEF DESCRIPTION OF THE PRESENT INVENTION

It is an object of the present invention to provide low head high volume pumping system for moving water into a fish farm.

Broadly, the present invention relates to a pump for moving large volumes of liquid against low heads of up to 1 meter comprising a housing defining a circumferential wall of an annular passage having a central axis, an impeller mounted for rotation on said vertical axis and having a hub portion and plurality of blades symmetrically positioned about said axis, each said blade having a root portion adjacent to the hub and a tip portion at a maximum diameter of said blade adjacent to said circumferential wall of said passage, each of said blades having a substantially elliptical platform shape and having a foil shaped cross section to provide a lift to drag ratio (L/D) of at least 75 to 1 under normal operating conditions when the Reynolds number of flow through the impeller is below $10^6$, each said blade having a center line (CL) skewed rearwardly relative to the direction of rotation of said impeller so that said center line of each blade curves rearward to the direction of rotation of said impeller through a sweep angle $\alpha$ defined by $$\alpha=\text{atan}(r_r/r_t)$$

where $r_r$ is the radius of the root of the blade $r_t$ is the radius of the tip of the blade and follows a curve defined by $$X_i=\text{Cosine } \theta_i * r_i$$

$$Y_i=\text{Sine } \theta_i * r_i$$

where $X_i$=X coordinate of points i along said center line of the blade in plane view and the X coordinate extends along a radial line extending from the axis of rotation of the impeller through a point of intersection of the center line with the hub.

$Y_i$=Y coordinate of points i along said center line of the blade in plane view and Y coordinate is substantially perpendicular to X $r_i$ is the radial distance from the point i from the axis of rotation, $\theta_i$ is the angle measured from the X axis at point i and is defined by $$\theta_i=\alpha(r_i-r_r)/(r_t-r_r)$$

each said blade having a foil configuration in the NACA4000 series, each said blade at any given radius $r_i$ having a pitch and an angle of attack to provide said lift to drag ratio for said blade.

Preferably each said blade will have a tip radius $r_t$ of between 50 cm and 150 cm, more particularly between 75 cm and 120 cm.

Preferably, each said blade will have a pitch angle from about 55° to 65° at the root to 12° to 20° at its tip and said angle of attack will be between 3° and 5°.

Preferably, said planer form shape will be an ellipse as major axis between 1.3 and 1.7× the maximum radius ($r_t$) of the impeller, more preferably 1.5*$r_r$.

Preferably, each blade will have a rake rearward of the direction of fluid flow of between 4° and 6°, more preferably 5°.

Preferably, said central axis is substantially vertical and said housing has a concentric vertical pipe extending thereabove, a float encircling said pipe and positioned to suspend said impeller therebelow.

Preferably, said vertical pipe and said housing mount said impeller to permit withdrawal of said impeller by movement substantially vertically through said pipe and said housing.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
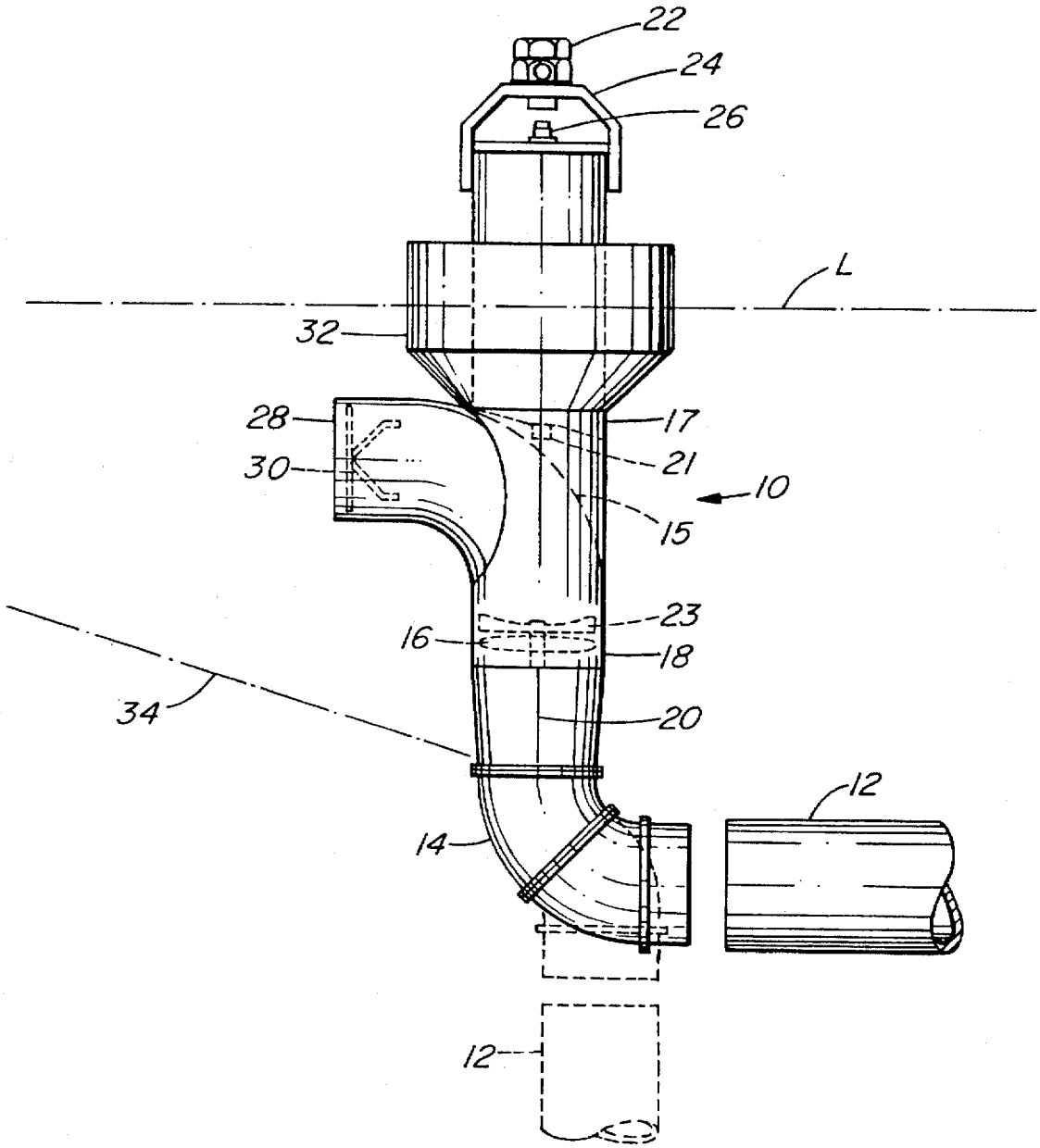
FIG. 1 shows a pumping system of the present invention mounted for delivering water to a fish growing station.

As shown in FIG. 1, the pumping system of the present invention comprises an inlet or intake to 12 and may be moved between the solid line position and the dotted line position or any place therebetween to adjust or change the level from which the water is being drawn. This movement is accommodated by the swivel joint 14.

An impeller 16 of the pump is contained within a housing 18 that forms a circular peripheral wall having a substantially vertical central axis or center line 20 about which the impeller 16 rotates. The impeller is driven by a suitable motor which in the illustrated arrangement is shown as a hydraulic motor 22, connected via flexible coupling 24 and thrust bearing 26 to a shaft as schematically represented by the center line 20 to drive the impeller 16.

The shroud schematically illustrated at 15 diverts the flow generated by the impeller 16 toward the outlet 28. The shroud 15 is designed to permit leakage so that on startup of the pump any significant surges flow into the substantially vertical pipe section 17 and dampen the flow.

The whole pumping system is floated by a floatation collar 32 that supports the motor 22 well above the fluid level L and maintains the impeller 16 well below the level L. The position of the floatation collar 32 surrounding the upper end of the pipe section 17 with the intake system and the impeller 16 suspended therebelow provides a stable system that is not unduly swayed by for example wave movement.

It is preferred that the shaft 20 be substantially vertical and thus, the pipe 17 is substantially vertical and are held in this substantially vertical position by the float 32 that surrounds the pipe 17. The shaft 20 is mounted and positioned within the pipe 17 by suitable bearings such as the spider bearing 21 and a second spider bearing not shown, but supported by the static vanes 23 which extend across the full diameter of the housing 18.

It will be noted that the pipe 17 and housing 18 have a substantially constant inside diameter from the impeller 16 (static vanes 23 in the illustrated arrangement) through to the top or motor 22 end of the pipe 17. This structure permits, generally when the motor 22 is uncoupled from the shaft 20 and moved out of the way, the shaft 20 including the shroud 15, spider bearing 21, the impeller 16 and the illustrated arrangement with the static vanes 23 upstream of the impeller 16 to all be withdrawn vertically through the pipe 17. This system of withdraw is easily accomplished by known means for supporting and temporarily attaching the shroud 15, spider bearing and its support 21 and the static vanes 23 to the pipe 17 of housing 18.

The vanes 23 have been shown as positioned above or upstream of the impeller 16, but they more preferably will be positioned on the downstream side of the impeller 16 i.e. side remote from the motor 22 and to extend the shaft 20 to project beyond the impeller 16 to be received in a suitable bearing supported in the static vanes 23. With this arrangement removal of the impeller 16 may be made even simpler as now the shaft need only be released from the bearing on the static vanes 23 and the static vanes 23 need not be lifted with the impeller 16.

The outlet 28 delivers liquid, particularly water, into the confined zone or bag, generally indicated at 34 that contains the fish being grown in the fish farm.

Figure 2:
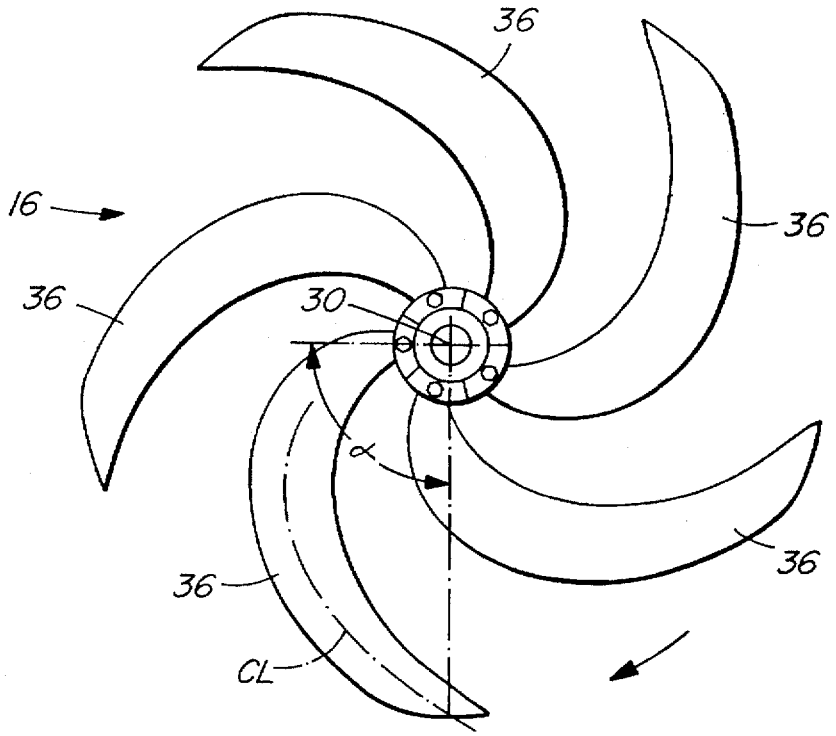
FIG. 2 is a plan view of an impeller assembly constructed in accordance with the present invention.
Figure 3:
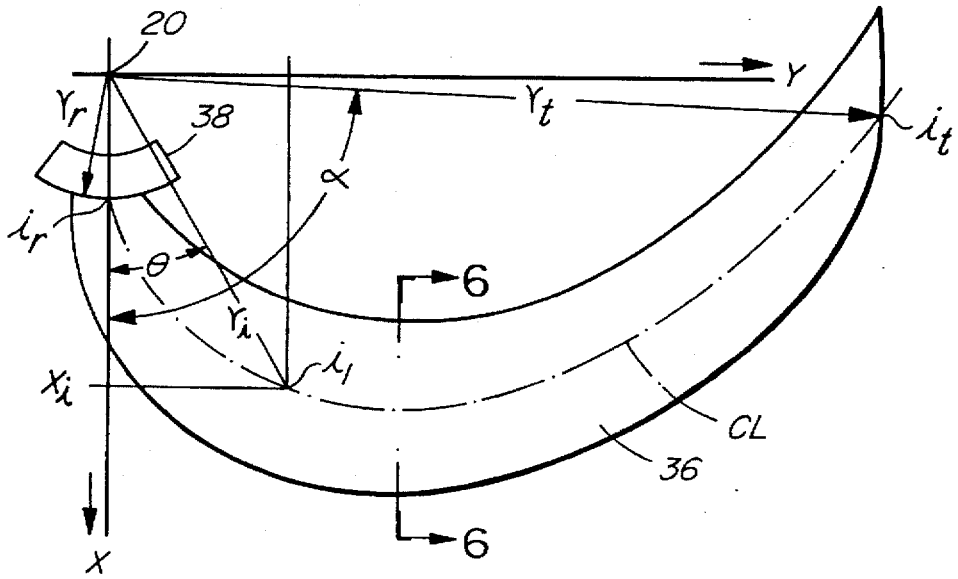
FIG. 3 is a plan view of a blade construction in accordance with the present invention.

The impeller 16 as shown in plan view in FIG. 2 is composed via a plurality of blades 36 (5 in the illustrated arrangement) which are substantially identical and are symmetrically positioned circumferentially about the hub 38 which is the centered on the axis of rotation 20 of the impeller. Each of the blades has a axial center line CL that is curved as shown in FIG. 3.

The number of blades will be a prime number, i.e. 3, 5, 7, 11, and the blades will be positioned symmetrically around the axis or shaft 20. The greater the number of blades, the slower the rotational speed of the impeller for a given throughput.

The blades are all the same and operate effectively at low blade loading, i.e. at a head of less than about 1 meter(m) and deliver relative large flows in the order of 1 $m^3$/sec per enclosure and has a large turn down ration without impairing significantly the efficiency of the pumping operation. One pump may be used to deliver liquid to a number of separate enclosures or confinement zones.

Each of the blades delivers water at a high lift to drag ratio (L/D) greater than 75 to 1, preferably up to 100 to 1 at a low Reynolds number below $10^6$. To obtain this high L/D each of the blades has a foil cross-section selected from National Advisory Committee of Aeronautics (NACA) series of foil shapes particularly the NACA4000 series of foils (See Abbot, I. H. and A. E. von Doenhoff, 1959, Theory of Wing Sections, Dover Publications, New York).

To maintain the Reynolds number in the range required (below $10^6$), the velocity of the fluid through the pump must be maintained relatively low, generally, under about 5 m/sec. Thus, to achieve the required high flows, a relatively large impeller diameter and large housing diameter is required. The present invention will normally have an impeller diameter of at least 50 cm and less than 150 cm more preferably between about 75 to 120 cm and a hub 38 diameter of between 10 and 20% preferably 15% of the impeller diameter. The diameter of the impeller will be greater than 93% of the inside diameter of the encircling housing 18 so that the clearance is less than 7% of the housing inside diameter of the housing 18. If the clearance is too large the effectiveness and efficiency of the pump will be significantly effected.

The center line CL (see FIG. 3) of the blade is skewed in the opposite of the direction of rotation of the impeller. Generally, the center line CL will extend over an arc defined by a sweep angle α which in turn is defined by $$\alpha=\arctan(r_r/r_t)$$

where $r_r$ is the radius of the root of the blade $r_t$ is the radius of the tip of the blade the shape of the center line is defined by the formula $$X_i=\text{Cosine } \theta_i * r_i$$

$$Y_i = \text{Sine } \theta_i * r_i$$

where $X_i$=X coordinate of points i along said center line of the blade in plane view and the X coordinate extends along a radial line extending from the axis of rotation of the impeller through a point of intersection of the center line with the hub.

$Y_i$=Y coordinate of points i along said center line of the blade in plane view and Y coordinate is substantially perpendicular to X $r_i$ is the radial distance from the point i from the axis of rotation, $\theta_i$ is the angle measured from the X axis at point i and is defined by $$\theta_i = \alpha(r_i - r_r)/(r_t - r_r)$$

The curvature of the center line CL is relatively uniform from its root position designated as $i_r$ and its maximum or tip $i_t$.

It is important that the skewedness of the impeller blades 36 as defined by α and θ be shaped to increase the apparent aspect ratio of the blades, reduce the operating noise and permit the blades to be essentially self-cleaning.

Figure 6:
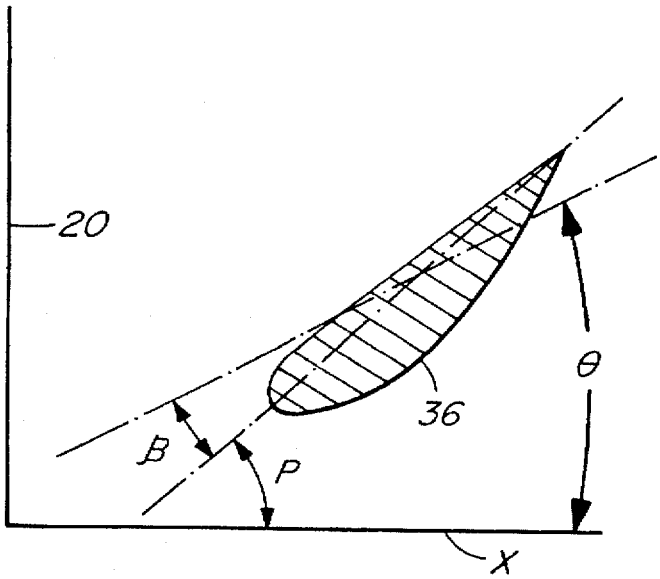
FIG. 6 is a section along the line 6—6 of FIG. 3.

The blades have pitches P that vary along their length measured from the axis of rotation 20 of the impeller 16 to maintain the desired angle of attack. The pitch angle P is the angle between the X plane perpendicular to the axis of rotation of the shaft 20 and the cord connecting the leading and trailing edges of the blade (see FIG. 6)

The angle of attack β is set to be between about 3° and 5°, preferably about 4° and thus the approach angle φ varies from the root $i_r$ to the tip $i_t$ of each blade in accordance with the change in pitch angle P i.e. φ=P−β. The approach angle φ at the root of each blade (i.e. $\phi_r$) being between about 50° and 70°, preferably about 60° and at the tip (i.e. $\phi_t$) being between 12° and 20° preferably about 16°.

Figure 4:
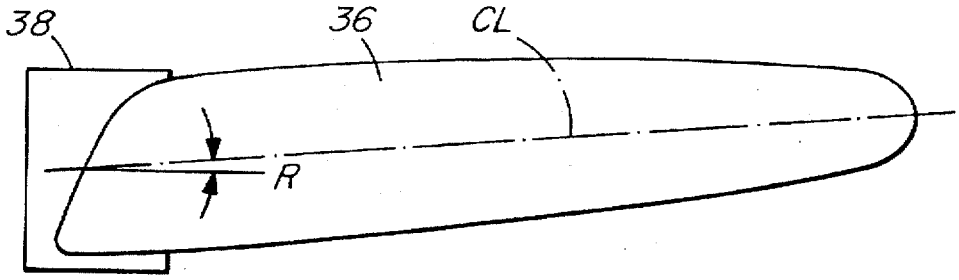
FIG. 4 is a plan view of the blade.
Figure 5:
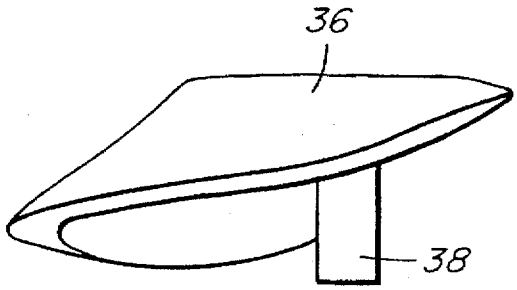
FIG. 5 is the end view of the blade.

It is also preferred that the center line CL of each blade 36 be raked slightly in the direction of fluid travel, i.e. the center line of the blade at the tip of the blade will be advanced in the direction of travel of the fluid relative to the center line of the blade at the root. Generally, this angle indicated at R in FIG. 4 will be in the range of 4° to 6°, preferably 5°.

Each of the blades will have a semi-elliptical shape about the center line CL when viewed in platform as shown in FIG. 3. Preferably, the ellipse will have a major axis approximately 1.5 times the maximum the length of the center line CL between points $i_r$ and $i_t$.

EXAMPLE

An impeller having a maximum radius $r_t$ equal to about 46 cm and a hub diameter of about 6.7 cm was formed using NACA4421 foil shape at the blade root with a smooth transition to a NACA4412 shape at the tip so that the foil sections smoothly curve from the root to the tip of each of the blade. The impeller was mounted in a housing having an inside diameter of 94 cm. The blade angle α was 81° and the skewedness was defined as above described by the formula $$X_i = \text{Cosine } \theta_i * r_i$$

$$Y_i = \text{Sine } \theta_i * r_i$$

where $X_i$=X coordinate of points i along said center line of the blade in plane view and the X coordinate extends along a radial line extending from the axis of rotation of the impeller through a point of intersection of the center line with the hub.

$Y_i$=Y coordinate of points i along said center line of the blade in plane view and Y coordinate is substantially perpendicular to X $r_i$ is the radial distance from the point i from the axis of rotation, $\theta_i$ is the angle measured from the X axis at point i and is defined by $$\theta_i = \alpha(r_i - r_r)/(r_t - r_r)$$

The blade pitch was set so that the approach angle varied from 61.8° at the root to 16° at the tip and the angle of attack was set at 4°. The rake angle of the center line was 5°. Each impeller blade had a semi-elliptical area distribution about the center line CL in panel form based on the ellipse who's major axis is approximately 1.5 times the maximum radius of the impeller.

The impeller incorporated five blades as illustrated. This impeller design meets the specifications as set forth in Table I.

TABLE I

| | of nominal flow* | | | | | | | |
|---|---|---|---|---|---|---|---|---|
| Impeller Specs | 25% | 50% | 75% | 100% | 108% | 117% | 125% | |
| advance velocity | 0.732 | 1.464 | 2.197 | 2.929 | 3.173 | 3.417 | 3.661 | m/s |
| rotation | 1.104 | 2.207 | 3.311 | 4.415 | 4.783 | 5.151 | 5.519 | rps |
| | 66 | 132 | 199 | 265 | 287 | 309 | 331 | rpm |
| axial velocity | 0.855 | 1.710 | 2.565 | 3.420 | 3.705 | 3.990 | 4.275 | m/s |
| tip radial velocity | 2.982 | 5.964 | 8.946 | 11.928 | 12.922 | 13.916 | 14.910 | m/s |
| hub radial velocity | 0.458 | 0.915 | 1.373 | 1.831 | 1.983 | 2.136 | 2.289 | m/s |
| thrust | 0.405 | 1.622 | 3.649 | 6.486 | 7.612 | 8.829 | 10.135 | kN |
| drag | 177 | 708 | 1.593 | 2.832 | 3.324 | 3.855 | 4.425 | N |
| torque | 44 | 176 | 395 | 702 | 824 | 956 | 1.098 | Nm |
| effective power | 0.3 | 2.4 | 8.2 | 19.5 | 24.8 | 30.9 | 38.1 | kW |
| advance ratio | 0.771 | 0.771 | 0.771 | 0.771 | 0.771 | 0.711 | 0.771 | |
| impeller loading | 1.023 | 1.023 | 1.023 | 1.023 | 1.023 | 1.023 | 1.023 | |

*nominal flow equals 1.94 $m^3$/sec.

It is apparent from the results obtained that the impeller is very effective for moving water under low head conditions over a significant turn down range.

Having described the invention, modifications will be evident to those skilled in the art without departing from the scope of the invention as defined in the appended claims.

We claim:

1. A pump for moving large volumes of liquid against low heads of up to 1 metercomprising a housing defining a circumferential wall of an annular passage having a central axis, an impeller mounted for rotation on said vertical axis and having a hub portion and plurality of blades symmetrically positioned about said axis, each said blade having a root portion adjacent to the hub and a tip portion at a maximum diameter of said blade adjacent to said circumferential wall of said passage, each of said blades having a substantially elliptical platform shape and having a foil shaped cross section to provide a lift to drag ratio (L/D) of at least 75 to 1 under normal operating conditions when the Reynolds number of flow through the impeller is below $10^6$, each said blade having a center line (CL) skewed rearwardly relative to the direction of rotation of said impeller so that said center line of each blade curves rearward to the direction of rotation of said impeller through a sweep angle $\alpha$ defined by $$\alpha=\text{atan}(r_r/r_t)$$

where $r_r$ is the radius of the root of the blade $r_t$ is the radius of the tip of the blade and follows a curve defined by $$X_i=\text{Cosine } \theta_i * r_i$$

$$Y_i=\text{Sine } \theta_i * r_i$$

where $X_i$=X coordinate of points i along said center line of the blade in plane view and the X coordinate extends along a radial line extending from the axis of rotation of the impeller through a point of intersection of the center line with the hub $Y_i$=Y coordinate of points i along said center line of the blade in plane view and Y coordinate is substantially perpendicular to X $r_i$ is the radial distance from the point i from the axis of rotation, $\theta_i$ is the angle measured from the X axis at point i and is defined by $$\theta_i=\alpha(r_i-r_r)/(r_t-r_r)$$

each said blade having a foil configuration in the NACA4000 series, each said blade at any given radius $r_i$ having a pitch and an angle of attack to provide said lift to drag ratio for said blade.

2. A pump for moving large volumes of liquid as defined in claim 1 wherein each said blade has the same tip radius $r_t$ of between 50 cm and 150 cm.

3. A pump for moving large volumes of liquid as defined in claim 1 wherein each said blade has the same tip radius $r_t$ of between 75 cm and 120 cm.

4. A pump for moving large volumes of liquid as defined in claim 1 wherein each said blade has a pitch angle P in the range of 55° to 65° at the root smoothly converting to a pith angle P of between 12° to 20° at its tip and has a substantially constant angle of attack $\beta$ of between 3° and 5°.

5. A pump for moving large volumes of liquid as defined in claim 1 wherein said planer form shape will be an ellipse as major axis between 1.3 and 1.7× the maximum radius ($r_t$).

6. A pump for moving large volumes of liquid as defined in claim 2 wherein said planer form shape will be an ellipse as major axis between 1.3 and 1.7× the maximum radius ($r_t$).

7. A pump for moving large volumes of liquid as defined in claim 3 wherein said planer form shape will be an ellipse as major axis between 1.3 and 1.7× the maximum radius ($r_t$).

8. A pump for moving large volumes of liquid as defined in claim 4 wherein said planer form shape will be an ellipse as major axis between 1.3 and 1.7× the maximum radius ($r_t$) of the impeller, more preferably $1.5_{rT}$.

9. A pump for moving large volumes of liquid as defined in claim 1 wherein each blade has a rake rearward of the direction of fluid flow of between 4° and 6°.

10. A pump for moving large volumes of liquid as defined in claim 2 wherein each blade has a rake rearward of the direction of fluid flow of between 4° and 6°.

11. A pump for moving large volumes of liquid as defined in claim 3 wherein each blade has a rake rearward of the direction of fluid flow of between 4° and 6°.

12. A pump for moving large volumes of liquid as defined in claim 4 wherein each blade has a rake rearward of the direction of fluid flow of between 4° and 6°.

13. A pump for moving large volumes of liquid as defined in claim 5 wherein each blade has a rake rearward of the direction of fluid flow of between 4° and 6°.

14. A pump for moving large volumes of liquid as defined in claim 6 wherein each blade has a rake rearward of the direction of fluid flow of between 4° and 6°.

15. A pump for moving large volumes of liquid as defined in claim 7 wherein each blade has a rake rearward of the direction of fluid flow of between 4° and 6°.

16. A pump for moving large volumes of liquid as defined in claim 8 wherein each blade has a rake rearward of the direction of fluid flow of between 4° and 6°.

17. A pump for moving large volumes of liquid as defined in claim 1 wherein said central axis is substantially vertical and said housing has a concentric vertical pipe extending thereabove, a float encircling said pipe and positioned to suspend said impeller therebelow.

18. A pump for moving large volumes of liquid as defined in claim 17 wherein said vertical pipe and said housing mount said impeller to permit withdrawal of said impeller by movement substantially vertically through said pipe and said housing.

19. A pump for moving large volumes of liquid as defined in claim 4 wherein said central axis is substantially vertical and said housing has a concentric vertical pipe extending thereabove, a float encircling said pipe and positioned to suspend said impeller therebelow.

20. A pump for moving large volumes of liquid as defined in claim 19 wherein said vertical pipe and said housing mount said impeller to permit withdrawal of said impeller by movement substantially vertically through said pipe and said housing.

* * * * *

UNITED STATES PATENT AND TRADEMARK OFFICE

CERTIFICATE OF CORRECTION

PATENT NO. : 5,681,146
APPLICATION NO. : 08/726258
DATED : October 28, 1997
INVENTOR(S) : White It is certified that error appears in the above-identified patent and that said Letters Patent is hereby corrected as shown below:

Column 2 line 20; column 4 line 60; and column 7 line 24 (claim 1)

"$\alpha = \arctan(r_r / r_t)$" should read -- $\alpha = \arctan(r_t / r_r)$--

Column 6 line 9

"81°" should read --$85.8^{0}$--

Signed and Sealed this

Eighteenth Day of September, 2007

JON W. DUDAS
*Director of the United States Patent and Trademark Office*